United States Patent [19]

Shimizu et al.

[11] 4,303,848

[45] Dec. 1, 1981

[54] DISCHARGE LAMP AND METHOD OF MAKING SAME

[75] Inventors: Kenichi Shimizu, Fujisawa; Akihiro Kamiya, Yokosuka; Shu Yamazaki, Yokohama; Riozo Akiyama, YoJosuka; Teruji Makuuchi, Yokohama; Shiichiro Yoshizaki, Tokyo, all of Japan

[73] Assignee: Toshiba Corporation, Kawasaki, Japan

[21] Appl. No.: 70,707

[22] Filed: Aug. 29, 1979

[51] Int. Cl.[3] ..... H01J 1/14; H01J 19/06; H01K 1/04

[52] U.S. Cl. ..... 313/346 R; 313/218; 313/311

[58] Field of Search ..... 313/346, 218, 311, 213

[56] References Cited

U.S. PATENT DOCUMENTS

| | | | |
|---|---|---|---|
| 4,052,634 | 10/1977 | De Kok | 313/218 |
| 4,097,762 | 6/1978 | Hilton et al. | 313/346 R |
| 4,136,227 | 1/1979 | Saito et al. | 313/346 R |
| 4,152,619 | 5/1979 | Bhalla | 313/346 R |
| 4,152,620 | 5/1979 | Bhalla | 313/346 R |

FOREIGN PATENT DOCUMENTS

| | | | |
|---|---|---|---|
| 51-74480 | of 1976 | Japan | 313/218 |

*Primary Examiner*—Saxfield Chatmon, Jr.
*Attorney, Agent, or Firm*—Schuyler, Banner, Birch, McKie & Beckett

[57] ABSTRACT

In a discharge lamp comprising a sintered electrode comprising a high temperature melting metal such as tungsten, molybdenum, tantalum or mixtures thereof as a main ingredient of the sintered electrode and an electron emissive material of an alkaline earth metal or compound thereof, the sintered electrode further comprising at least one oxide of a metal selected from the group consisting of yttrium, zirconium and aluminum.

6 Claims, 6 Drawing Figures

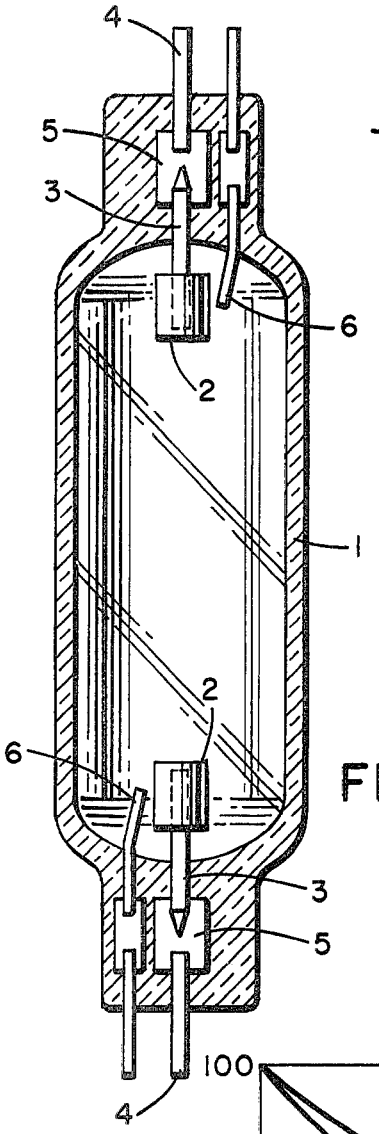
FIG. 1
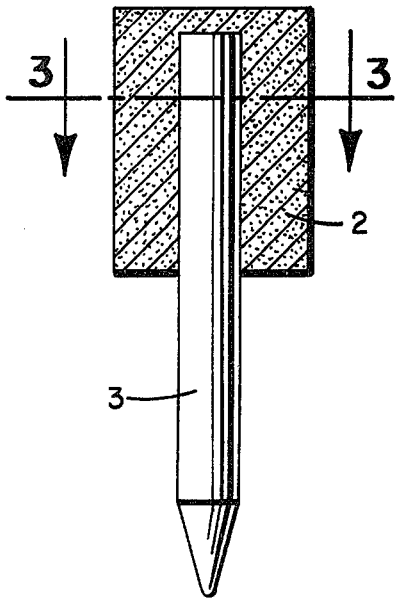
FIG. 2
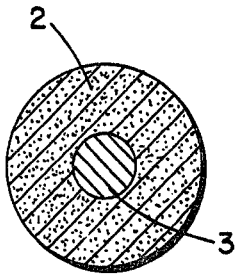
FIG. 3
FIG. 4
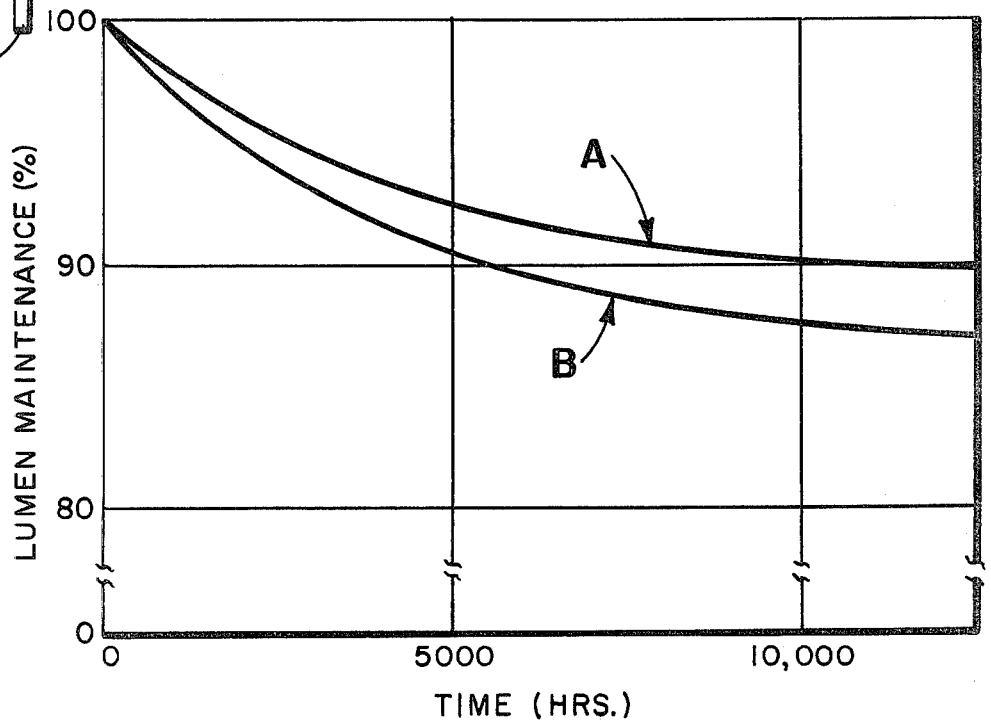

DISCHARGE LAMP AND METHOD OF MAKING SAME

BACKGROUND OF THE INVENTION

This invention relates to a discharge lamp and more particularly to such a lamp comprising a sintered electrode.

Generally, the desired characteristics for a discharge lamp are low ignition voltage, low radio frequency noise, high lumen, and maintaining the high lumen for a sufficiently long period of time. These characteristics depend upon the electron emissive electrode installed in the envelope of the discharge lamp. There are two types of electrodes known in the prior art: one being a coil structure whereby the electron emissive material is contained in the coiled tungsten, and the other being the sintered electrode consisting of a high temperature melting material powder such as tungsten and an emissive material powder such as an alkaline earth metal carbonate.

Although the coil structure produces a discharge lamp having a low ignition voltage, its electron emissive material is easily sputtered by electron or gas ion bombardment. Consequently, its lamp life is reduced significantly. On the other hand, the sintered electrode produces a discharge lamp whereby the electron emissive material is not easily sputtered; this secures long lamp life and low radio frequency noise.

The discharge lamp utilizing the sintered electrode, however, does not maintain a high lumen for a sufficiently long period of time. Due to evaporation of the electron emissive material at high temperatures and some sputtering of the material by electron or ion bombardment, blackening of the lamp's walls occurs. The evaporated or sputtered material attaches to the inner wall of the discharge lamp envelope near the sintered electrode and produces the blackening. As a result, the lumen of the discharge lamp is prevented from passing through the lamp's wall and the lamp loses the desired lumen maintenance.

In order to reduce blackening, an improved sintered electrode has been manufactured by the prior art process of sintering the mixture of an electron emissive powder consisting of barium-calcium tungstate (i.e., sintered emitter) with a base metal powder consisting of tungsten and thorium oxide powder. The barium-calcium tungstate is produced by sintering tungsten oxide, barium carbonate and calcium carbonate in air at high temperatures (i.e., sintered emitter process). Although the prior art sintered electrode formed by this process reduces blackening, the temperature conditions necessary for establishing a high quality of the electrode are critical when the sintered emitter is subsequently sintered with the other powders. Further, the use of thorium oxide has obvious disadvantages due to its radioactive properties.

SUMMARY OF THE INVENTION

It is an object of the invention to provide a discharge lamp having low ignition voltage, high lumen and long life. It is a further object of the invention to provide a discharge lamp having a non-radioactive sintered electrode which can be easily manufactured.

According to this invention, there is provided a discharge lamp comprising a sintered electrode which comprises a base metal selected from the group consisting of tungsten, molybdenum, tantalum and mixtures thereof and an electron emissive material containing at least one alkaline earth metal or alkaline earth metal compound, wherein the sintered electrode further contains at least one oxide of a metal selected from the group consisting of yttrium, zirconium, aluminum and mixtures thereof, the oxide comprising from about 3% to about 30% by weight of the sintered electrode.

The invention further provides a method comprising the steps of:

(1) forming a mixture of a high temperature melting metal powder and at least one oxide selected from the group consisting of yttrium, zirconium and aluminum, (2) adding an alkaline earth metal compound to said mixture from (1);

(3) compacting said mixture from (2) to form an article, and (4) sintering said compacted article.

The high temperature melting metal constitutes the electrode base metal. Such a metal, and in particular tungsten, is able to resist the high temperature load during operation of the lamp, and reacts with the other ingredients on sintering to make a better electron emitting electrode. For example, barium-calcium tungstate can be used as the electrode base metal; it is obtained by reacting tungsten, barium oxide and calcium oxide.

Yttrium oxide, zirconium oxide and/or aluminum oxide will make an electron emitting material upon reaction with alkaline earth metal compounds. If the content of the oxide is less than 3% by weight of the sintered electrode, the oxide will not be effective, and if its content is more than 30% by weight of the sintered electrode, the strength of the sintered electrode will be reduced. The content of the alkaline earth metal compound can be varied in accordance with electron emission characteristic desired, particularly in the range from about 5% to about 40% by weight of the sintered electrode.

BRIEF DESCRIPTION OF THE DRAWINGS

FIG. 1 is a longitudinal sectional view of a discharge lamp incorporating the sintered electrode of this invention.

FIG. 2 is an enlarged sectional view of the sintered electrode shown in FIG. 1.

FIG. 3 is an enlarged sectional view taken along lines 3—3 of FIG. 2.

FIGS. 4, 5 and 6 are graphs comprising the operational characteristics of a lamp constructed in accordance with the invention and a prior art lamp.

DETAILED DESCRIPTION OF THE PREFERRED EMBODIMENT

Figure 5:
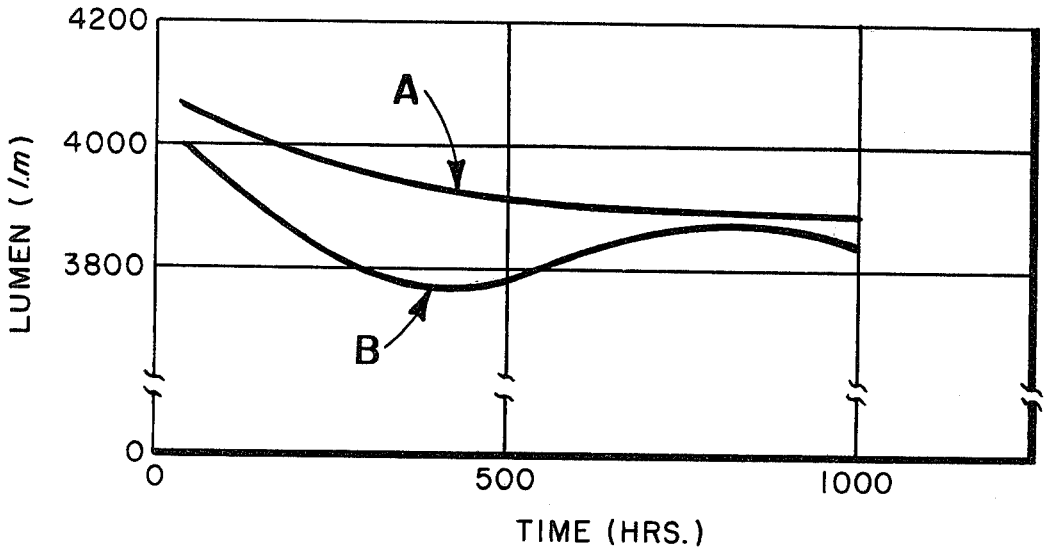

Referring now to FIGS. 1–3, the discharge lamp according to this invention is provided with a tubular envelope (1) of quartz or ceramic containing a pair of sintered electrodes (2) coaxially within and near the ends thereof. Positioned adjacent to each electrode is an ignition electrode 6. Electrode supporting rods (3) of high temperature melting metal such as tungsten form a part of the electrode. These supporting rods project into the envelope to support the electrodes and also provide an electrical connection in combination with molybdenum foils (5) from each outer pin (4) to its respective electrode 2. The envelope contains sealed mercury vapor and a gas suitable to provide a discharge in a predetermined pressure range. The electrode (2) comprises a base metal such as tungsten, yttrium oxide, zirconium oxide, a barium compound and a calcium compound. Tungsten is the major component of the electrode. Oxides of yttrium and zirconium generally constitute 3–30%, preferably 10–15%, by weight of the electrode. Barium and calcium compounds can be present in amounts of 5–40%, preferably 10–15%, by weight of the electrode.

In manufacturing the electrode, a base metal powder mixture comprising tungsten, yttrium and zirconium powders, each less than about 10 μm in size is mixed with an organic binder such as cetyl alcohol or polystyrene and allowed to dry to form agglomerates. The agglomerates are then granulated to give an average particle size of 60–300 μm, by crushing with a ball mill and sieving. An electron emissive powder mixture comprising barium carbonate and calcium carbonate (in a 2:1 ratio by weight) and having a particle size of less than about 110 μm, is converted to granules of an average particle size of 110–180 μm using the aforementioned technique. Both powders are then mixed in a base metal powder to electron emissive powder ratio of about 9 to 1 by weight, and compacted preferably in association with a supporting rod 3 at pressures of about 3 ton/cm$^2$ to form a composite article as shown in FIG. 2. The density of the resulting compacted powder portion of the composite article is greater than about 7.0 g/cm$^3$. This composite article is then heated in a reducing atmosphere e.g., one containing hydrogen, at temperatures of 300°–400° C. to remove the organic binder from the body and subsequently is sintered for about 60 minutes under reducing conditions at 1000° C. or more, preferably 1400°–1600° C. to provide the cylindrical composite body as shown in FIGS. 2 and 3. The diameter and the height of the sintered electrode may vary with the intended use. In a typical one hundred watt high pressure mercury vapor lamp the electrode can be 3 mm in diameter and 2.3 mm high.

The sintered electrode of the present invention can be sealed in the discharge lamp envelope without change in quality despite the heat and mechanical shocks on sealing. The above-described granulation technique is effective to homogenize each component in the body and to prevent undesired reactions between the base metal and the alkaline earth metals in the sintered electrode due to reduced contact area between the components. Accordingly, the composition of the electrode remains substantially unchanged during operation of the lamp, thereby extending the life thereof. The sintered electrode of the instant invention may be produced using electron emissive powders of the above-listed ingredients without granulation. Also, the sintered electrode of the instant invention may be produced using a base metal powder mixture of the above listed ingredients without granulation. On operation of the discharge lamp using the sintered electrode of the instant invention, discharge starting voltage less than 120 V, reduced radio frequency noise and favorable lumen maintenance were obtained.

As shown in FIG. 4, the lumen maintenance characteristics of the lamp of this invention (the curve A), is compared with the lumen maintenance characteristics of a known lamp using W/$ThO_2$/(BaCa)O electrode (the curve B). Clearly the lamp of the instant invention is superior to the prior art lamp. Namely, the lamp in accordance with this invention maintains a 90% lumen after 10,000 hours while the prior art lamp maintained only 87% lumen after the same time.

Figure 6:
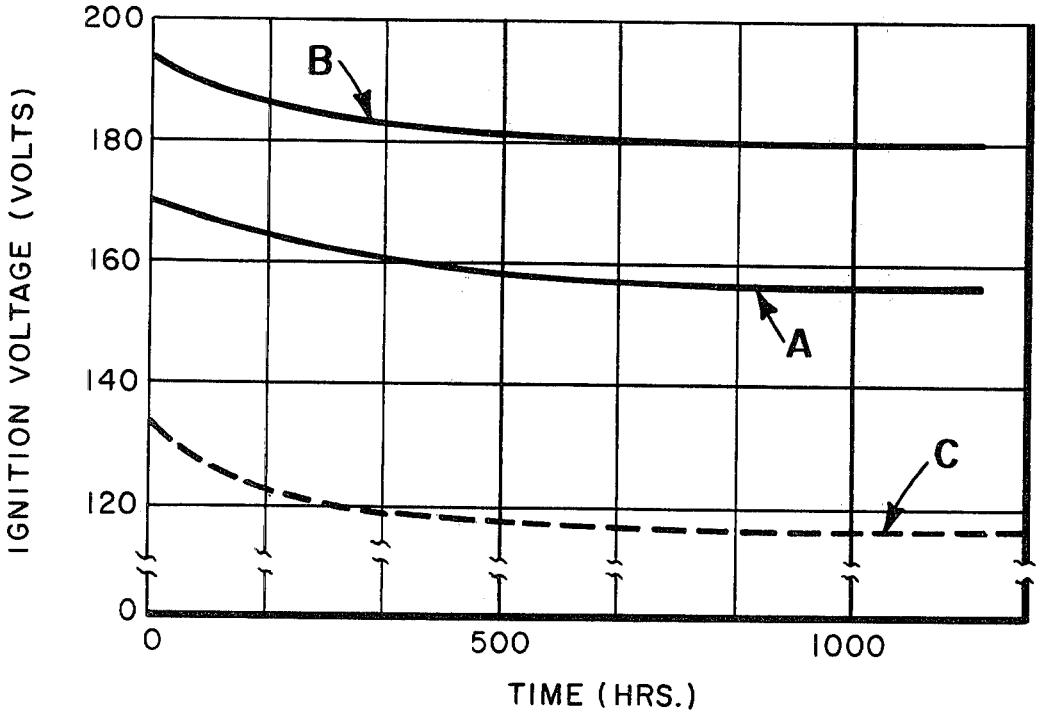

FIGS. 5 and 6 represent, respectively, the change in luminous flux from starting to 1000 hours and the change in ignition voltage at −20° C. from starting to 1000 hours. Curve A shows the characteristics according to this invention while curve B shows the characteristics of the prior art lamp. The curve C of FIG. 6 represents the change in ignition voltage of the lamp according to this invention at room temperature. A comparison of curves A and B demonstrates both a stable luminous flux and reduced ignition voltage characteristics of the discharge lamp of the instant invention.

Besides tungsten, the base metal of the sintered electrode can be molybdenum, tantalum or an alloy thereof. Rather than yttrium oxide and zirconium oxide, another suitable oxide is aluminum oxide. One or more of these oxides can be used to obtain the sintered electrode of the invention. The use of yttrium oxide allows the electrode to be easily sintered since this oxide combines chemically with tungsten and molybdenum at relatively low temperatures. Sintering temperature shortly higher than needed with yttrium oxide is required if either zirconium oxide and aluminum oxide is used. On the other hand, the oxides of zirconium and aluminum will produce less sputtering than yttrium oxide when subjected to ion bombardment. Combining yttrium oxide with any one or more of the other above-mentioned oxides will produce an electrode which can be easily manufactured due to its low sintering temperature.

Furthermore, manufacturing is facilitated with the absence of thorium oxide which has an obvious disadvantage due to is radioactive properties.

We claim:

1. A discharge lamp comprising a sintered electrode comprising a high temperature melting metal selected from the group consisting of tungsten, molybdenum, tantalum and mixtures thereof as a main component and at least one oxide of a metal selected from the group consisting of yttrium, zirconium, aluminum and mixtures thereof, said oxide comprising from about 3% to about 30% by weight of said sintered electrode, and an alkaline earth metal compound as an electron emitting material sintered together with said high temperature melting metal and said oxide, said alkaline earth metal compound comprising from about 5% to about 40% by weight of said sintered electrode.

2. A discharge lamp according to claim 1 wherein said alkaline earth metal compound comprises an alkaline earth metal carbonate.

3. The method of manufacturing a sintered electrode used for a discharge lamp comprising:

(1) forming a mixture of a high temperature melting metal powder and at least one oxide selected from the group consisting of yttrium, zirconium and aluminum, (2) adding an alkaline earth metal compound to said mixture from (1);

(3) compacting said mixture from (2) to form an article, and (4) sintering said compacted article.

4. The method according to claim 3 wherein mixing step (1) includes the step of:

forming agglomerates of the powder mixture with an organic binder, crushing the agglomerates to form granules.

5. Method according to claim 4 wherein step (2) includes the step of granulating said alkaline earth metal compound.

6. Method according to claim 5 wherein said alkaline earth metal compound is barium-calcium carbonate.

* * * * *